US012480278B2

(12) United States Patent
Raffuzzi et al.

(10) Patent No.: US 12,480,278 B2
(45) Date of Patent: Nov. 25, 2025

(54) MACHINE FOR PERFORMING EXCAVATIONS, IN PARTICULAR FOR DRILLING, AND METHOD ASSOCIATED TO SUCH MACHINE

(71) Applicant: SOILMEC S.P.A., Cesena (IT)

(72) Inventors: Mirco Armando Raffuzzi, Cervia (IT); Francesco Mantovani, Cesena (IT)

(73) Assignee: SOILMEC S.P.A., Cesena (IT)

( * ) Notice: Subject to any disclaimer, the term of this patent is extended or adjusted under 35 U.S.C. 154(b) by 485 days.

(21) Appl. No.: 18/020,124

(22) PCT Filed: Jul. 22, 2021

(86) PCT No.: PCT/IB2021/056638

§ 371 (c)(1),
(2) Date: Feb. 7, 2023

(87) PCT Pub. No.: WO2022/029537

PCT Pub. Date: Feb. 10, 2022

(65) Prior Publication Data

US 2023/0323628 A1 Oct. 12, 2023

(30) Foreign Application Priority Data

Aug. 7, 2020 (IT) ..... 102020000019597

(51) Int. Cl.
*E02F 5/20* (2006.01)
*E02D 7/22* (2006.01)
(Continued)

(52) U.S. Cl.
CPC ..... *E02F 5/20* (2013.01); *E02D 7/22* (2013.01); *E02D 13/06* (2013.01); *E02F 9/264* (2013.01); *E21B 7/02* (2013.01)

(58) Field of Classification Search
CPC .... E02F 5/20; E02F 9/264; E02F 3/06; E02D 7/22; E02D 13/06; E02D 5/56; E21B 7/02; E21B 44/00; G01M 17/03
See application file for complete search history.

(56) References Cited

U.S. PATENT DOCUMENTS

2006/0289205 A1* 12/2006 Law ..... E21B 7/024 175/122
2013/0020775 A1* 1/2013 Beji ..... B60B 35/10 280/43
2016/0281335 A1* 9/2016 Benzal ..... E02F 3/32

FOREIGN PATENT DOCUMENTS

CN 103912218 A 7/2014
EP 2578757 A1 10/2013
(Continued)

OTHER PUBLICATIONS

International Search Report and Written Opinion received for PCT Serial No. PCT/IB2021/056638 on Feb. 10, 2022, 10 pgs.

*Primary Examiner* — Hunter B Lonsberry
*Assistant Examiner* — Henry R Hinton
(74) *Attorney, Agent, or Firm* — Merchant Gould P.C.

(57) ABSTRACT

A machine and method utilize a tracked undercarriage including a frame with a central body, front and rear transverse assemblies connected to the central body and extending on opposite sides. Each of a pair of lateral tracks is connected, at the front and at the rear, to ends of the transverse assemblies. The base machine includes excavation equipment having different working positions/configurations. Each of a pair of front load cells of the tracked undercarriage is mounted between a lateral track and the front transverse assembly. Each of a pair of rear load cells is mounted between a lateral track and the rear transverse assembly. Each load cell detects force data indicating the reaction force exerted between the associated lateral track
(Continued)

and the respective transverse assembly. A control system computes a barycentre planar position of the machine situated substantially at a reference plane computed as a function of the force data.

30 Claims, 13 Drawing Sheets

(51) Int. Cl.

| | |
|---|---|
| ***E02D 13/06*** | (2006.01) |
| ***E02F 9/26*** | (2006.01) |
| ***E21B 7/02*** | (2006.01) |

(56) References Cited

FOREIGN PATENT DOCUMENTS

| | | | |
|---|---|---|---|
| JP | S61287696 | A | 12/1986 |
| JP | H09105155 | A | 4/1997 |
| JP | 2013108245 | A | 6/2013 |
| JP | 5248361 | B2 | 7/2013 |
| WO | 2014166331 | A1 | 10/2014 |
| WO | 2018045542 | A1 | 3/2018 |

* cited by examiner

101

MACHINE FOR PERFORMING EXCAVATIONS, IN PARTICULAR FOR DRILLING, AND METHOD ASSOCIATED TO SUCH MACHINE

CROSS-REFERENCE TO RELATED APPLICATION(S)

This application is a National Stage Application of PCT/IB2021/056638, filed 22 Jul. 2021, which claims benefit of Serial No. 10 2020 000019597, filed 7 Aug. 2020 in Italy, and which applications are incorporated herein by reference. To the extent appropriate, a claim of priority is made to each of the above disclosed applications.

Technical Field

The present invention relates to a machine for making excavations, in particular for drilling, and to a method associated with such machine.

Technical Background

Machines for making excavations are known which include drilling machines equipped with a tracked undercarriage. In particular, within the field of machines for foundation excavations, three main families of drilling machines exist: a first family includes drilling machines for small-diameter piles, also referred to as micropiles, which are typically small machines not equipped with an on-board operator station, used in different soil reinforcement techniques, or in probing or geothermal applications; a second family includes drilling machines for large-diameter piles, usually employed for drilling circular holes with diameters in excess of 600 mm, such drilling machines being much bigger than the previously mentioned ones and being equipped with an on-board operator station; a third family includes diaphragm wall excavation machines, which perform rectangular cross-section excavations mostly for retention or waterproofing works, the geometry of such machines being similar to that of construction cranes, and which are also equipped with an on-board operation station. All three of the above-mentioned main families of drilling machines have a common feature consisting of including an undercarriage with two tracked sides or, using more common terminology, two tracks for moving the machine on the ground.

The base machine develops on top of the tracked sides, and contains power units, such as an endothermal engine and hydraulic pumps, transmission means, such as winches, in addition to housing control equipment and systems and the operator's control station. Pile or micropile drilling machines are provided with a mast, which is a member generally having a rectangular cross-section that extends vertically even for a few tens of meters and is connected to the front end of the base machine through a hinge or a suitable kinematic mechanism consisting of one or more arms and hydraulic cylinders, which allow it to be tilted or positioned in space relative to the base machine.

Along said mast a rotary drilling head slides, also referred to as rotary, which is connected to the drill string fitted with a tool.

While they have a base machine which is very similar, or even identical, to that of pile drilling machines, in diaphragm wall excavation machines the mast is replaced with a lattice or boxed arm that supports, by means of ropes, the excavation tool, generally consisting of a bucket or a cutter.

A problem which is s common to all of the different machine types is the inherent risk of overturning which arises from the particular disposition of the masses, due to the considerable vertical extension of the mast or lattice arm and of the loads suspended therefrom, as well as to the action of external forces generated in different operating conditions, e.g. the force generated by the wind, which is normally detrimental to stability. This translates into the need for the operator to monitor the degree of stability of the machine in order to be able to safely perform the excavation operations. In fact, insufficient stability may expose the operator to the risk of the machine turning over, resulting in serious consequences for the people involved in the event.

According to reference standards, the stability calculation is based on the sum of all moments, i.e. overturning moments and stabilizing moments, that act simultaneously upon the machine. The parameter taken into consideration to evaluate stability is the "stability angle", also referred to as "residual stability angle", which represents the residual angle at which the machine, subject to a system of loads, including dynamic loads, can be inclined relative to one of the overturning lines before turning over.

Such residual stability angle must be calculated in the different conditions in which the machine is expected to be, e.g. also during transport, assembly, maneuvering, parking and operation.

A first method known in the art for facing the risk of overturning relies on safety rules specifically applying to this sector, according to which, during the design phase, and therefore prior to use, the coordinates of the barycentre of the machine must be computed with respect to a reference origin and, starting from such coordinates, the residual stability angle must be evaluated with respect to the closest overturning line, taking into account the masses involved, external loads, wind force, inertia forces, centrifugal force, dynamic effects, ground slope. For the machine to be considered to be stable, said residual stability angle must be always greater than a value indicated in such specifications, which will depend on the state of the machine (working, moving, idle).

Given that the overturning lines, defined in the technical standards as those lines which join the contact points of the lowest supports of the track rollers in the direction of travel, or those lines that cross the centres of the contact areas of the supports in the direction perpendicular to the direction of travel, are known at the design stage, in order to compute the residual stability angle it is necessary to know the position of the barycentre of the machine, inclusive of all installed excavation equipment and tools.

The values required for computing the position of the barycentre of the machine are based on measured or assumed values of the masses of the main fixed and movable components of the drilling equipment and tools to be used, an approximate assessment of the action of the wind, estimated calculations of the inertia forces, assumptions concerning the loads and, lastly, the very geometry of the machine. When defining such values, considerable approximations are generally resorted to because the operator cannot evaluate exact instantaneous safety margins, since he is only aware of limits defined a priori during the design phase, such as, for example, a maximum working radius or a maximum mast tilting angle. Such limits defined beforehand, being subject to inaccuracy due to lack of real-time measurements in the actual operating context of the machine, are provided on a precautionary basis, in order to keep the machine and the operator in acceptable safe conditions. This first method has, therefore, an impact that may have adverse effects on the working conditions of the machine due to the precautionary restrictions imposed thereon. For example, the maximum working distances of the mast and of the kinematic mechanism are in this case calculated a priori and limited by safety devices, assuming that the movable masses of the machine, e.g. parts movable by actuators, are in the most unfavourable positions for stability. However, when the masses are in less unfavourable positions, such limits set a priori may adversely affect the performance of the machine.

Other known systems try to overcome the above-described drawbacks by resorting to control systems and software installed aboard the machine, which, based on information received from suitable sensors located on the movable members of the machine, utilize an electronic computer to compute the barycentre position and possibly setting limits for the operation of the machine. For example, sensors may be installed which detect, either directly or indirectly, the instantaneous position of the kinematic mechanism of the machine, the position of the mast and/or of the rotary and of the tool-equipped drill string. Through additional sensors, it is then possible to know the angular position of the upper structure with respect to the undercarriage and to a reference axis.

Usually such systems utilize, especially as concerns the values of the masses of the machine components, a dataset pre-loaded into a database included in the management software. Such data are required by the software of the control system to compute the barycentre of the machine, after having identified the spatial positions of said components by means of dedicated sensors.

When working on construction sites, it may often occur that the machine operator needs to change the configuration of the equipment of the drilling machine, by replacing or adding components, in order to switch from an operating configuration dedicated to a certain excavation technology to another, or that he simply needs to change the tool. For example, modular elements may be added to the mast to increase its length, or additional components may be installed, such as an excavation tool cleaner or a second rotary for driving a casing, or a drill bit having a certain diameter may be replaced with a bigger, and hence heavier, one. In these cases, the control systems of such known machines require the user to intervene manually via an interface, e.g. a display, to correctly set in the software the new values of the masses of the components that have been changed in the machine equipment, so that the software will consider said new values in the stability calculation. This need for manual intervention by the operator, or by authorized personnel, e.g. the yard foreman, is generally due to the fact that, until now, it has been particularly difficult to identify sensor types which can be installed either on the machine or directly on each interchangeable component of the machine and which can detect the above-mentioned possible equipment modifications, e.g. the replacement of a component with another interchangeable component. This need for manual intervention by the operator makes such systems poorly reliable, since they are subject to human error or improper use. As a matter of fact, the user may enter into the software wrong mass values and wrong installed component types, whether unintentionally due to inattention or intentionally in order to "deceive" the control system and obtain better performance. It is clear that such occurrences will lead to errors in the calculation of the residual stability angle, thus jeopardizing the safety of the operators and of the machine.

SUMMARY OF THE INVENTION

It is an object of the present invention to provide a machine and a method for making excavations, in particular for drilling, more in particular for making foundations, such machine and method being of an improved type and capable of overcoming the above-summarized drawbacks of the prior art.

According to the present invention, this and other objects are achieved through a machine and a method having the technical features set out in the appended independent claims.

It is understood that the appended claims are an integral part of the technical teachings provided in the following detailed description of the present invention. In particular, the appended dependent claims define some preferred embodiments of the present invention that include some optional technical features.

One advantage that can be attained through one embodiment of the present invention that will be described below lies in the use of a set of sensors configured for measuring all those instantaneous physical actions exerted on the machine which may have an impact on its stability. As will be detailed hereinafter, the system can compute the position of the barycentre of the machine without necessarily having to know the positions and the masses of its various elements, in that it exploits the principle of the dynamic effect that external forces, whatever they may be, generate upon known points of the undercarriage of the machine.

Further features and advantages of 4.1 the present invention will become apparent in light of the following detailed description, provided merely as a non-limiting example and referring, in particular, to the annexed drawings as summarized below.

DETAILED DESCRIPTION OF THE INVENTION

Figure 1:
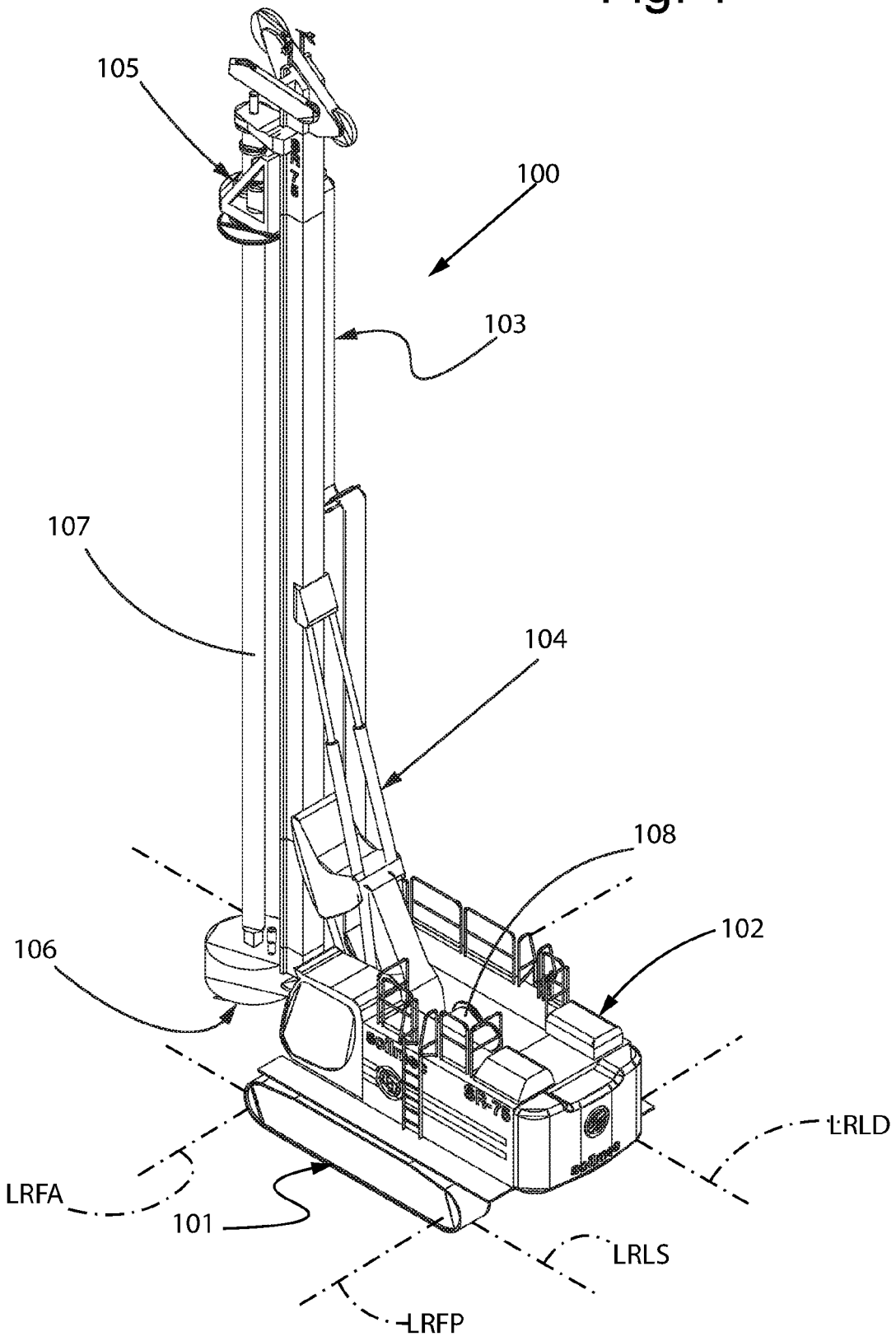
FIG. 1 shows a perspective view of a machine for making excavations, in particular for drilling, and more in particular for making foundations, such machine being made in accordance with an exemplary embodiment of the present invention. Such machine is, by way of non-limiting example, suitable for making large-diameter piles, although the teachings of the present invention are also applicable to other machine types, such as excavation machines, diaphragm wall excavation machines, or machines for making micropiles, or other types of construction machinery.

With particular reference to FIG. 1, there is shown an excavation machine 100 made in accordance with an exemplary embodiment of the present invention. In particular, machine 100 is a drilling machine, but in other alternative embodiments it may be a different type of machine, e.g. any construction machine fitted with a tracked undercarriage, such as an excavator or the like.

Machine 100 comprises a tracked undercarriage 101 and a base machine 102, e.g. an upper structure equipped with a control cabin, solidly connected to undercarriage 101. By way of non-limiting example, the connection between base machine 102 and undercarriage 101 is established through the interposition of a slewing ring (not shown), so that base machine 102 can rotate about the vertical axis of undercarriage 101. In further variant implementations (not shown), the base machine may be integral with the undercarriage.

Machine 100 further comprises excavation equipment adapted to take different working positions or configurations. In particular, the excavation equipment comprises a mast 103, situated in front of base machine 102, and an associated kinematic mechanism 104. Mast 103 is connected to base machine 102 through kinematic mechanism 104, which allows mast 103 to take different operating positions in space relative to base machine 102. In a simplified variant implementation, such kinematic mechanism 104 may even be a simple hinged connection between mast 103 and base machine 102 to permit tilting the mast.

Furthermore, the excavation equipment of machine 100 comprises a rotary driving head referred to as rotary 105, which can slide relative to mast 103, in particular axially along the longitudinal direction of the latter. In particular, the excavation equipment of machine 100 comprises also an excavation tool 106; with reference to FIG. 1, excavation tool 106 is connected to the bottom end of a string of telescopic pipes, or "kelly bars", 107 connected to rotary 105. In a per se known manner, rotary 105 is configured for imparting a rotational motion to string of pipes 107 and to excavation tool 106. At the same time, rotary 105 is configured for translating the string of pipes 107 and tool 106. In particular, during the drilling process rotary 105 is configured for translating tool 106 downwards and applying a thrust force to tool 106. Rotary 105 is also configured for translating the tool 106 upwards by applying a pulling force.

Machine 100 further comprises a winch 108, which may be installed either in base machine 102 or in mast 103, and which, through a rope running on a pulley installed on the top part of the mast, is connected to the string of telescopic pipes 107. By winding and unwinding said rope, winch 108 can, respectively, cause the string of telescopic pipes 107 and tool 106 to go up or down; in particular, when extracting the tool from the excavation, it can apply a stronger pulling force to the tool in order to overcome the weights and friction involved.

Such thrust and pulling forces are taken into account in the stability calculations used in the prior art, since they can generate overturning moments on the machine.

FIG. 1 also shows the possible overturning lines of the machine; in particular, LRFA indicates the front overturning line, LRFP indicates the rear overturning line, LRLS indicates the left lateral overturning line, and LRLD indicates the right lateral overturning line.

Figure 2A:
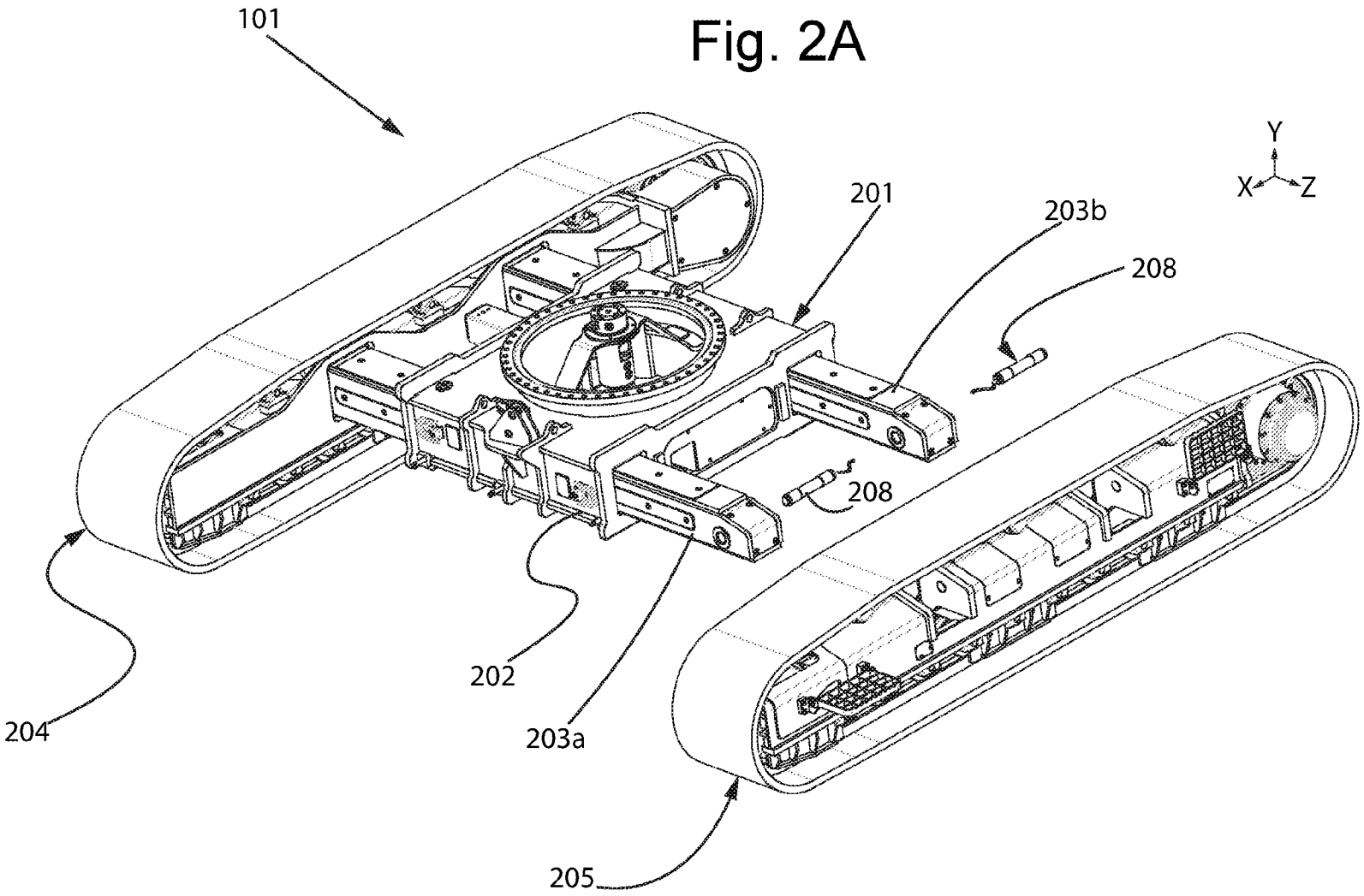
FIG. 2A shows a partially exploded perspective view of an undercarriage belonging to the machine shown in FIG. 1.

With particular reference to FIG. 2A, it shows in more detail the components of undercarriage 101. Such undercarriage 101 comprises a frame 201 that, in the illustrated embodiment, includes in its turn a central body 202. In proximity to its centre, central body 202 is-advantageously, but not necessarily-machined in a per se known manner to house a slewing ring (not shown), which acts as a connection with base machine 102.

In particular, frame 201 further comprises a front transverse assembly or front crossmember 203*a* and a rear transverse assembly or rear crossmember 203*b*. Transverse assemblies 203*a* and 203*b* are connected, e.g. either integrally or with the possibility of sliding sideways, to central body 202. The connection between transverse assemblies 203*a* and 203*b* and central body 202 may thus be either fixed (e.g. accomplished by welding) or it may be effected through a "prismatic" coupling allowing relative. In particular, transverse assemblies sliding 203*a*, 203*b* are rotatably integral with central body 202, preventing any rotation/inclination of the crossmembers with respect to the central body.

Each transverse assembly or crossmember protrudes with a first end from a side of central body 202 and protrudes with a second end from the opposite side of central body 202.

In the illustrated embodiment, each transverse assembly 203*a* and 203*b* consists of a single element; however, in further variants (not shown) each one of the transverse assemblies may comprise a respective pair of separate beam-like members arranged coaxial, and preferably connected telescopically, to each other. Such telescopic connection permits a mutual axial sliding movement of the two elements of one transverse assembly 203*a* and 203*b*, and permits changing the distance of each end of one transverse assembly from the sides of central body 202.

Moreover, undercarriage 101 comprises a right track 204 and a left track 205. Each one of tracks 204, 205 is connected, at the front and at the rear, to the respective ends of transverse assemblies 203*a*, 203*b* protruding on the same side from central body 202. In particular, each one of transverse assemblies 203*a* and 203*b* has at its ends suitable fixing means for connecting to right track 204 on one side and to left track 205 on the other side.

In FIG. 2A a reference system is also defined, which has its origin in a "reference plane" X-Z, which is a horizontal plane that may coincide with, for example, the plane in which the undercarriage tracks lie on the ground, and which has axis X oriented along the direction of travel of the undercarriage and positioned equidistant from both tracks.

Axis Z belongs to the reference plane and is oriented perpendicular to the direction of travel, and axis Y is perpendicular to the plane in which the undercarriage lies and is oriented upwards.

As will be apparent to a person skilled in the art, the adjectives front and rear, as well as right and left, should be considered to refer to a direction of travel of machine 100.

Figure 2B:
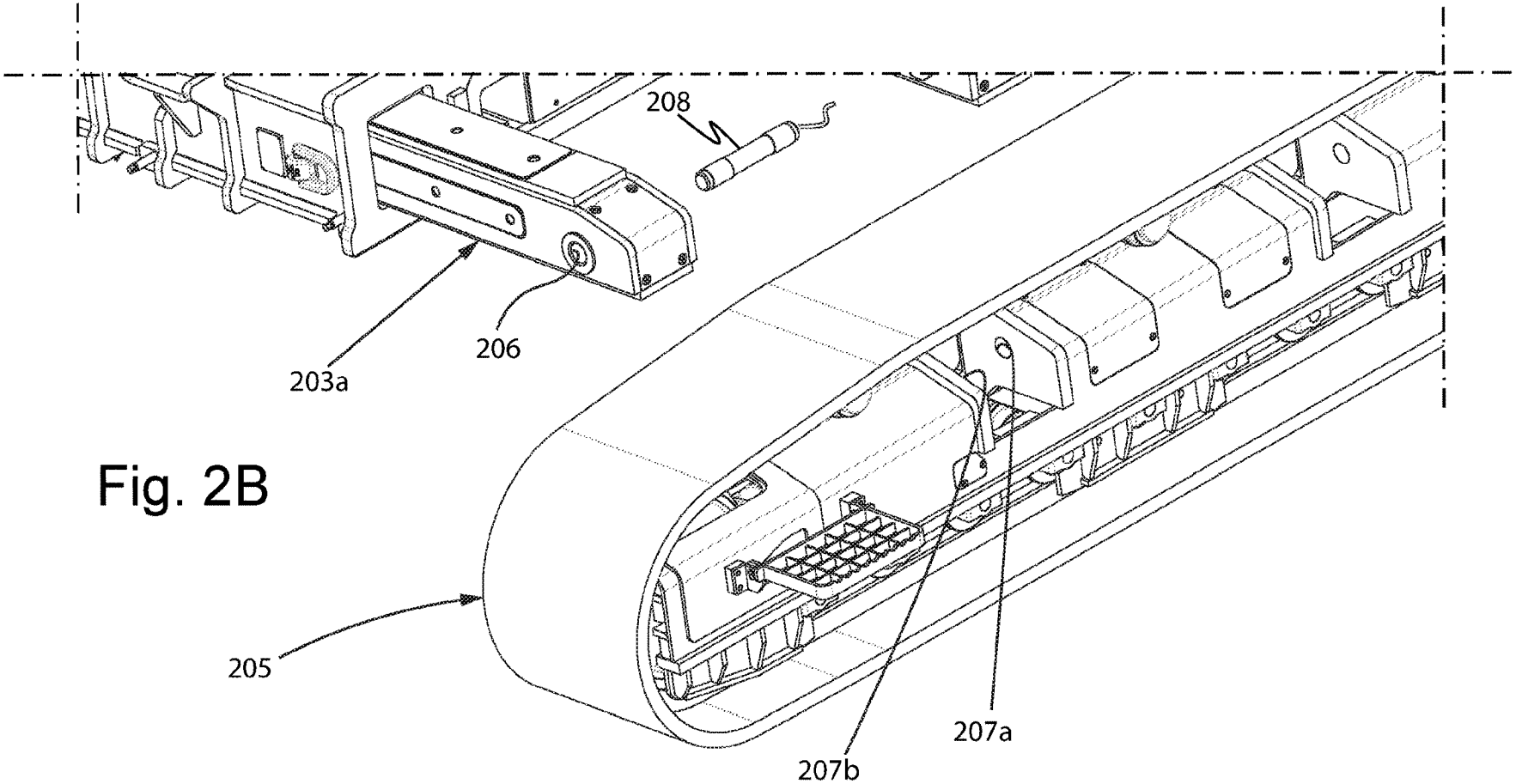
FIG. 2B shows a detailed perspective view of a first embodiment of the connection between the tracks and the frame of the undercarriage shown in FIG. 2A.

With particular reference to FIG. 2B, there is shown one of the connections between one end of transverse assembly 203*a* and the respective track 205, which is obtained, according to the embodiment of the present invention illustrated herein, through one or more fixing means. As to the corresponding connections between the ends of the other transverse assemblies and the respective tracks, which are not visible in FIG. 2B but are made in a similar manner in the illustrated embodiment, reference should be made to the following description of the connection shown in FIG. 2B. In particular, the above-mentioned fixing means comprises at least one first hole 206 formed at the end of transverse assembly 203*a*, at least one second hole 207*a* formed at the point of connection of track 205, and a pin-shaped load cell 208 inserted through said first hole 206 and said second hole, thus acting as a connection member between transverse assembly 203*a* and track 205. Preferably, the point of connection of the track consists of a cavity (or seat) formed in the side of the track, such cavity having a shape suitable for receiving and housing one end of transverse assembly 203*a* with some play.

Figure 2C:
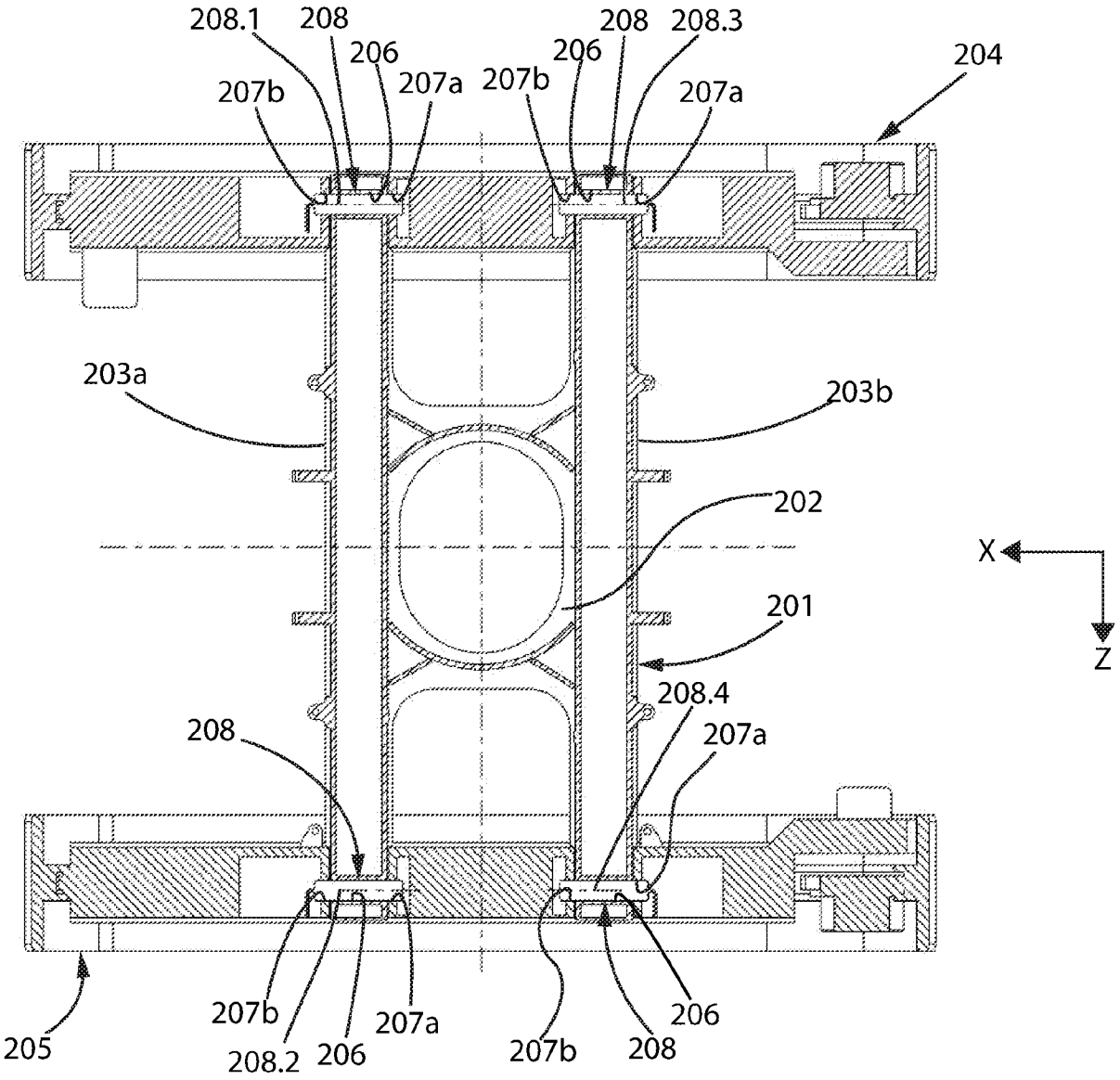
FIG. 2C shows a plan view of the undercarriage shown in the preceding figures, sectioned along a longitudinal horizontal plane.

As better visible in FIG. 2C of the exemplary embodiment illustrated herein, the point of connection of the track comprises, in addition to the second hole 207*a*, also a further second hole 207*b*, so that there are a pair of second holes 207*a*, 207*b*; however, it must be pointed out that, as will be apparent to a person skilled in the art, it is also conceivable to use, differently from this embodiment, just one second hole.

In particular, load cell 208—which is advantageously shaped as a pin—is inserted coaxial to the holes 206, 207*a* and 207*b*, thus acting as a connection member, as mentioned above.

As illustrated in FIGS. 2A, 2B, 2C, the connection established by inserting a single pin-shaped cell 208 is substantially a hinge, which permits relative rotation between respective track 204, 205 and the end of the respective transverse assembly 203*a*, 203*b* about the longitudinal axis of cell 208. Such rotation is however limited to a few degrees by the prismatic coupling established between the end of the respective transverse assembly 203*a*, 203*b* and the cavity representing the point of connection of the respective track 204, 205. Therefore, the play, i.e. the interspace between the end of the respective transverse assembly 203*a*, 203*b* and said cavity, determines the angle of relative rotation allowed between such transverse assembly 203*a*, 203*b* and the respective track 204, 205.

In the embodiment shown by way of example in FIG. 2C there is a single through hole 206 formed at the end of a transverse assembly 203*a* or 203*b* and a pair of coaxial holes 207*a* and 207*b* formed on the respective track 204 or 205.

According to the embodiment of the present invention illustrated in FIG. 2C, each one of the points of connection between frame 201 and the respective track 204 and 205 belonging to undercarriage 101 includes a respective load cell 208 of the above-described type. In particular, each one of the two tracks 204 and 205 of the undercarriage is connected to frame 201 at two connection points, and in particular each track 204, 205 is connected to two transverse assemblies 203*a*, 203*b*, so that four load cells 208 are installed in the undercarriage.

More in detail, according to the embodiment particularly visible in FIG. 2C, the four load cells 208 include:

- a front load cell 208.1 mounted at the point of connection between a lateral track 204 and front transverse assembly 203*a*,
- another front load cell 208.2 mounted at the point of connection between the other lateral track 205 and front transverse assembly 203*a*,
- a rear load cell 208.3 mounted at the point of connection between a lateral track 204 and rear transverse assembly 203*b*, and
- another rear load cell 208.4 mounted at the point of connection between the other lateral track 205 and rear transverse assembly 203*b*.

Figure 9:
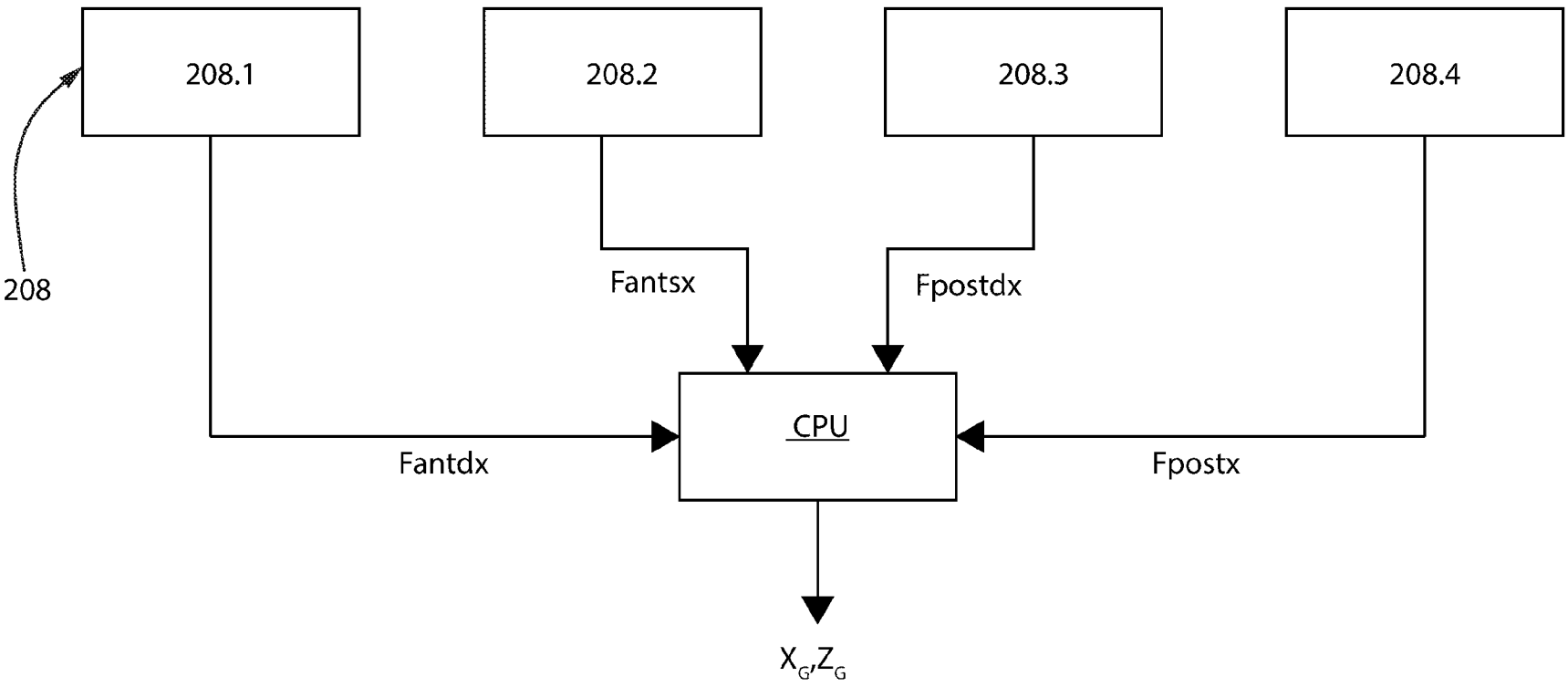
FIGS. 9 to 13 show different block diagrams that illustrate different methods of computing the planar and elevation coordinates of the barycentre and other parameters of the machines shown in the preceding figures.

With particular reference to FIG. 9, the signals collected from load cells 208 situated at the above-mentioned connection points correspond to force data $F_{antdx}$, $F_{antsx}$, $F_{postdx}$, $F_{postsx}$ Which are substantially representative of the forces acting upon load cells 208 themselves, at the points where they have been applied. Such force data $F_{antdx}$, $F_{antsx}$, $F_{postdx}$, $F_{postsx}$ are also indicative of the reaction force exerted between the associated lateral track 204, 205 and the respective transverse assembly 203*a*, 203*b* at the connection point. In particular, force data $F_{antdx}$ and $F_{antsx}$ are representative of the forces detected by right front load cell 208.1 and, respectively, by left front load cell 208.2; whereas $F_{postdx}$ and $F_{postsx}$ are representative of the forces detected by right rear load cell 208.3 and, respectively, left rear load cell 208.4.

As a function of the above-mentioned signals, corresponding to the directly measured reaction force data $F_{antdx}$, $F_{antsx}$, $F_{postdx}$ and $F_{postsx}$, it is possible to compute—instead of just assuming, as in the prior art—planar position $X_G$, $Z_G$ of the barycentre of machine 100 situated substantially at the level of a reference plane X-Z, as already described. It follows that, as can be understood by those skilled in the art, this system makes it possible to determine, with better precision compared with the current state of the art, the planar position of barycentre $X_G$, $Z_G$, even instant by instant, and hence the instantaneous residual stability angle. This advantageously allows the operator, when informed by a signalling system, to intervene in time in case of danger and/or to allow the machine to stay in and/or return to safe conditions, more effectively than prior-art machines, through the implementation of an optional control system.

As described above, the present invention permits identifying planar position $X_G$, $Z_G$ of the barycentre of the machine also by means of measurements of physical quantities actually acting upon the machine, and this is where it differs from the prior art, according to which the position of the barycentre is calculated exclusively starting from assumptions made a priori regarding the masses, forces and instantaneous positions of the elements and components that constitute the base machine.

According to the embodiment of the present invention illustrated herein, machine 100 is equipped with a system comprising a plurality of sensors, in particular a plurality of load cells 208 mounted on undercarriage 101. Load cells 208 permit, by measuring the reaction force between each one of tracks 204 and 205 and the respective transverse assembly 203*a*, 203*b*, an exact identification of the planar position of barycentre $X_G$, $Z_G$, computed in a reference plane, e.g. in the plane whereon machine 100 lies or in a horizontal plane. The computation of said planar position of barycentre $X_G$, $Z_G$ is carried out by a control system CPU as a function of force data $F_{antdx}$, $F_{antsx}$, $F_{postdx}$, $F_{postsx}$.

Merely by way of example, if the forces measured at the same instant by the right front load cell 208.1 and by the left front load cell 208.2 are identical in the absence of any external loads acting upon the machine, this means that coordinate $Z_G$ of the barycentre in the reference plane is equidistant from both ends of the front transverse assembly 203*a* and equidistant from both tracks 204, 206, so that $Z_G$ will have a value equal to zero and will be located on axis X according to the previously described reference system X-Y-Z. In accordance with a wholly similar principle, by combining the force values measured by all load cells it will be possible to determine the position of the barycentre in plane X-Z by computing the pair of values $X_G$, $Z_G$.

Furthermore, according to a preferred aspect of the present invention, it is also possible to compute the vertical position or coordinate of barycentre $Y_G$ above the reference plane, e.g. the plane whereon the machine lies, along a vertical axis, hereafter referred to as axis Y.

In order to compute the vertical position or coordinate along axis Y, different principles may be followed.

Figure 3:
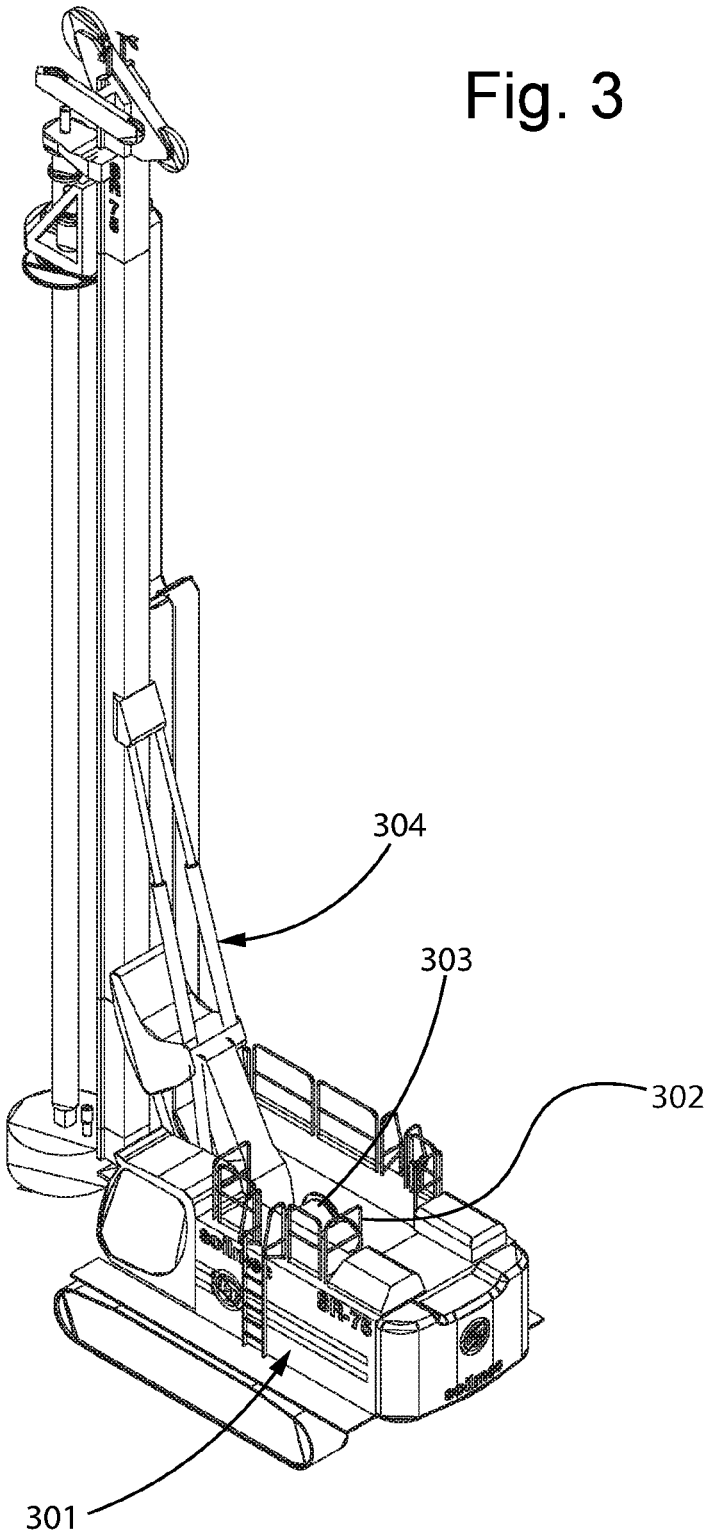
FIG. 3 is a perspective view of an excavation machine made in accordance with a further exemplary embodiment of the present invention, showing a group of sensors applied to such machine. Such machine is particularly suitable for drilling, e.g. for making large-diameter piles.

For example, one principle—per se known—that can be followed is the one represented herein by way of example with reference to FIG. 3. According to such principle, sensors are mounted on the actuators configured for moving the parts and components of machine 100, in particular of base machine 102. By way of non-limiting example, such actuators may include jacks, gear motors connected to the slewing ring for rotating base machine 102, and winches. Additional suitable sensors are also included, which provide information about the instantaneous position and spatial configuration of the excavation equipment of machine 100. More in detail, the sensors associated with such actuators may be, for example, an angular position sensor 301 associated with the slewing ring (e.g. an encoder mounted on such slewing ring), one or more additional angular position sensors (in this embodiment there are, in fact, a first angular position sensor and an additional second angular position sensor 302, 303) associated with winch 108 (or even with a plurality of respective winches), and one or more linear position sensors 304 associated with the jacks that control other parts and components of the excavation equipment of base machine 102. In this manner, it will be possible to estimate the height of the barycentre by applying a per se known computation principle, which in this case will be combined with the innovative and more accurate principle of computation of the planar position of barycentre $X_G$, $Z_G$ at the level of reference plane X-Z, e.g. the ground plane whereon the machine lies, measured in real time by means of the above-described load cells 208.

Figure 10:
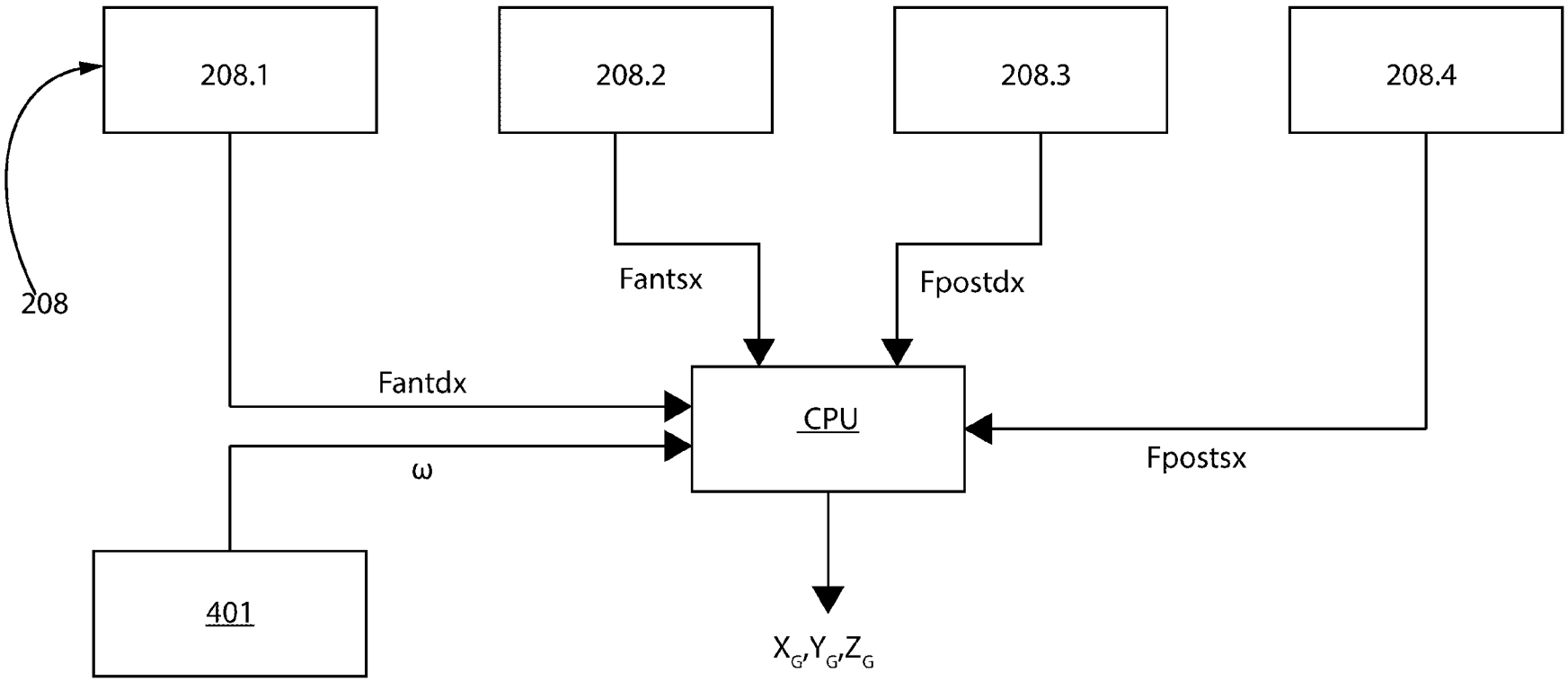

As an alternative to the principle described above with reference to FIG. 3, a further alternative example of a principle for the computation of the barycentre vertical position $Y_G$ along axis Y, combined with the computation of barycentre planar position $X_G$, $Z_G$ at the level of the reference plane X-Z, will now be described with reference to FIG. 4. The above-mentioned alternative principle is shown in the block diagram represented in FIG. 10. According to such principle, 401 is mounted on a supporting structure 402 belonging to base machine 102 and is configured for detecting angle data @ indicative of at least one angle of inclination between a reference axis of the base machine 102 and the direction of the force of gravity. Barycentre vertical position $Y_G$ is computed by control system CPU as a function of force data $F_{antdx}$, $F_{antsx}$, $F_{postdx}$, $F_{postsx}$ and angle data w. In the illustrated embodiment, the reference axis is the axis of the slewing ring. Barycentre planar position $X_G$, $Z_G$ at the level of the reference plane X-Z according to the principle shown in FIG. 11 is computed by the control system CPU as a function of force data $F_{antdx}$, $F_{antsx}$, $F_{postdx}$, $F_{postsx}$, in accordance with the principle shown in FIG. 10.

Inclinometer 401 may be of the single-axis type (thus detecting only one angle of inclination, measured in a predefined plane), but a two-axis inclinometer is preferably resorted to, so that a pair of angles of inclination can be detected which are indicative of the angular variation of the reference axis (e.g. the axis of the slewing ring) in different planes, in particular perpendicular to each other. In this latter case, the actual spatial position of the barycentre will be measured with better precision.

Figure 5:
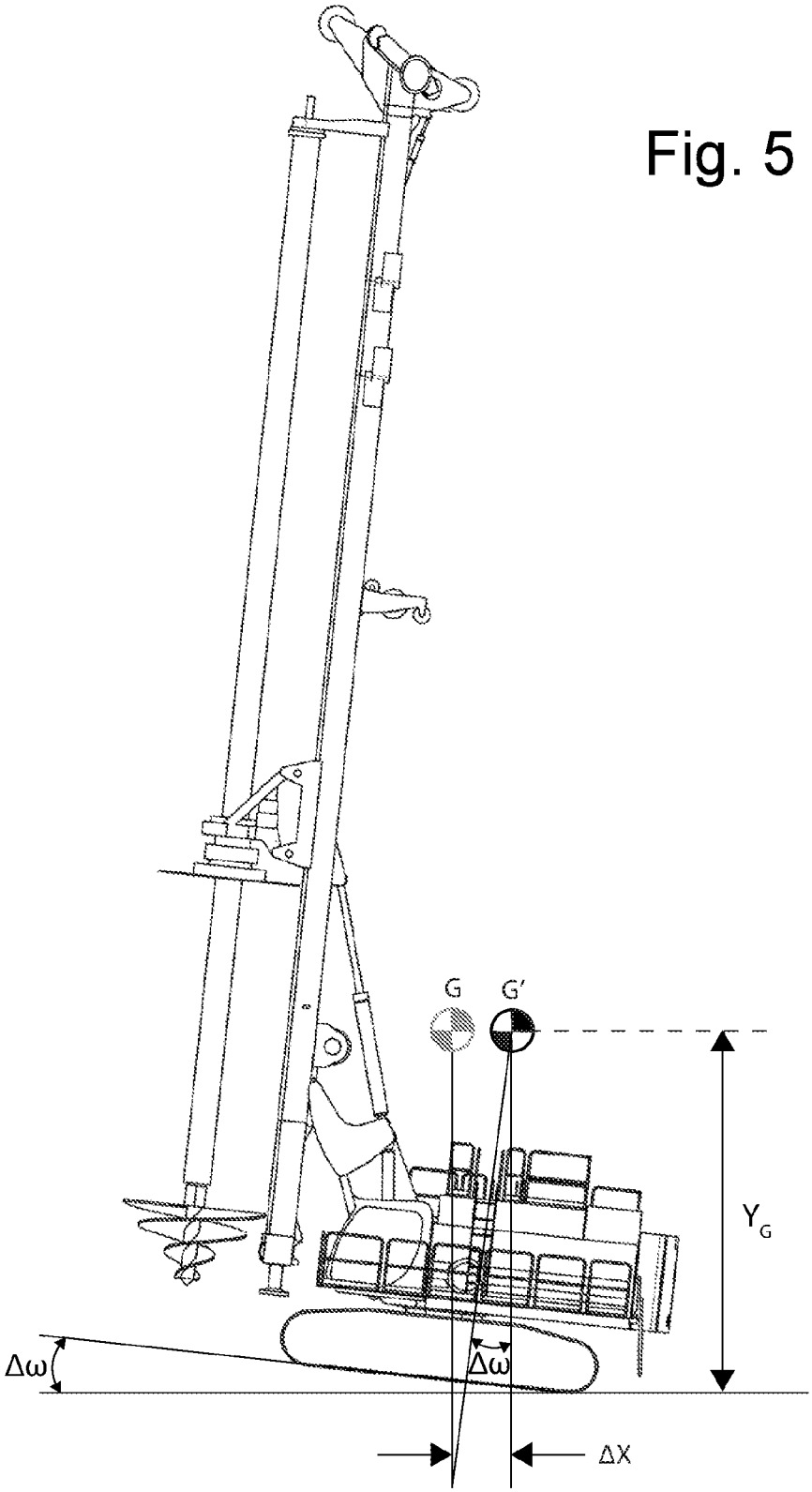
FIG. 5 is a side elevation view of the machine shown in FIGS. 3 and 4. This figure shows one possible example of geometric references and variables taken into account in the stability calculation, according to an advantageous embodiment of the present invention.

With reference to FIG. 5, there is shown in more detail one possible example of geometric references and variables taken into account for computing the barycentre and stability of machine 100, according to an advantageous embodiment of the present invention. In fact, machine 100 illustrated therein is essentially a tracked drilling machine made in accordance with the preceding figures and equipped with a slewing ring configured for allowing the rotation of base machine (or upper structure) 102. The adopted reference system uses, as its origin "O", the intersection between the level of the reference plane—e.g. considered to lie on the ground—and the axis of the slewing ring when it is perpendicular to the reference plane, while axis "Y" is positive upwards, axis "X" is positive forwards, and resulting axis "Z" is coherent with a right-handed triplet.

Figure 11:
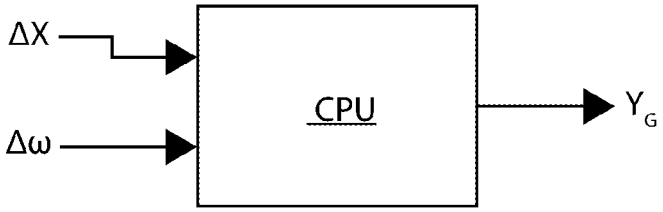
Figure 12:
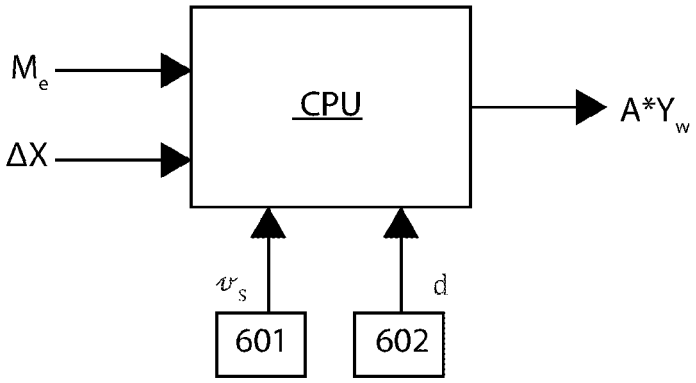

According to the block diagram of FIG. 11, barycentre vertical position $Y_G$ is computed by control system CPU as a function of:

- position variation ΔX of barycentre planar position $X_G$, $Z_G$ in the reference plane, and
- angle variation Δω of angle data ω detected by inclinometer 401. Position variation ΔX and angle variation Δω are computed between the same two consecutive instants, in particular between initial position G and final position G'.

More in detail, in the illustrated embodiment, to an angle variation Δω of the reference axis in a plane XY, computed on a axis X and accurately measured by inclinometer 401, a barycentre position variation corresponds which has a value ΔX, accurately assessed by means of load cells 208. In fact, on axis "X", abscissa coordinate $X_G$ of the barycentre position on axis "X" is given by the following formula:

$$X_c = \frac{X_{gsott} m_{sott} g + F_{antdx} X_{andx} + F_{antsx} X_{antsx} + F_{postdx} X_{postdx} + F_{postsx} X_{postsx}}{F_{adx} + F_{asx} + F_{pdx} + F_{psx} + m_{sott} g}$$

where:

- forces "F" are those read by load cells 208 (in particular, as previously described, $F_{antdx}$ and $F_{antsx}$ are the forces detected by the right front load cell 208.1 and by the left front load cell 208.2, while $F_{postdx}$ and $F_{postsx}$ are the forces detected by the right rear load cell 208.3 and by the left rear load cell 208.4);
- mass "$m_{sott}$" is the mass of that part of the undercarriage 101 which is below the load cells (between the load cells and the ground);
- coordinates "X" correspond to the abscissa coordinates of the above-mentioned forces and mass (in particular, $X_{antdx}$ and $X_{antsx}$ are the abscissa coordinates of the position of the right front load cell 208.1 and left front load cell 208.2, while $X_{postdx}$ and $X_{postsx}$ are the abscissa coordinates of the right rear load cell 208.3 and left rear load cell 208.1, $X_{gsott}$ is the abscissa coordinate of the mass $m_{sott}$);

acceleration "g" is the gravitational acceleration. Of course, right and left positions "X" will likely be equal due to a preferably symmetrical construction.

In order to obtain height coordinate $Y_G$, the following formula is used:

$$Y_G = \frac{\Delta X}{\tan(\Delta\omega)}$$

Therefore, according to such principle, the barycentre position can be computed by associating the readings of load cells 208, i.e. $F_{antdx}$, $F_{antsx}$, $F_{postdx}$ and $F_{postsx}$, with that of inclinometer 401, i.e. Δω.

Of course, in the case wherein inclinometer 401 is, advantageously, of the two-axis type, it is also possible to compute angle variation Δω as a function of the inclination of the slewing ring axis in plane YZ, in accordance with the principle illustrated above for plane XY, making the computation of the barycentre position globally more accurate through a comparison of the data obtained with reference to plane XY.

According to a variant embodiment of the present invention, the calculation of barycentre height $Y_G$ can be made by using both of the above-described principles at the same time. The comparison between the results obtained by the first principle (i.e. the one illustrated with reference to FIG. 3) and, respectively, the second principle (i.e. the one illustrated with reference to FIG. 4, wherein the readings of load cells 208, i.e. $F_{antdx}$, $F_{antsx}$, $F_{postdx}$ and $F_{postsx}$, are used in combination with that of the inclinometer 401, i.e. Δω), when used simultaneously, makes it possible to optimize the computed values. Moreover, the knowledge of the geometric position of the components of machine 100 allows informing the operator in real time, in addition to allowing the system to provide instantaneous feedback control over stability-critical parameters, so as to keep machine 100 in a condition of acceptable stability.

Figure 6:
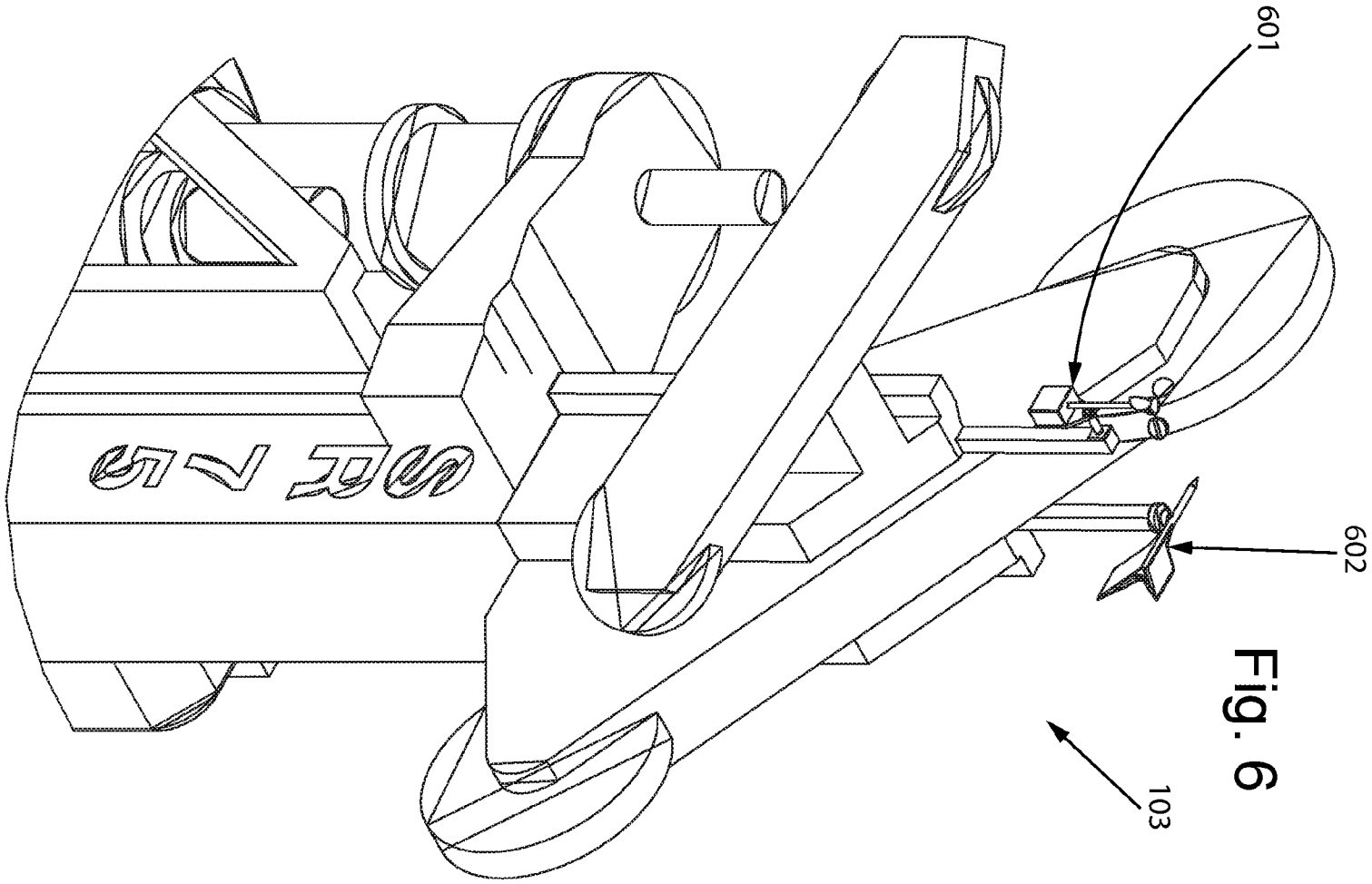
FIG. 6 is a magnified partial perspective view showing a detail of the top portion of a mast of the machine of FIGS. 3 to 5, whereon an anemometer and a vane have been applied, according to an advantageous embodiment of the present invention.

FIG. 6 shows a detailed view of the top part of mast 103 of a further construction variant of machine 100. In such area of mast 103, machine 100 preferably comprises means for detecting the speed of the wind, e.g. an anemometer 601 and a vane 602. According to a preferred aspect of the present invention, anemometer 601 and vane 602 are configured for computing the influence exerted by the force of the wind, in any direction, upon the residual stability angle.

More in detail, due to the possibility of computing, at any instant, barycentre coordinates $X_G$, $Z_G$ at the level of the reference plane X-Z based on the reaction forces measured by cells 208 according to the method already described with reference to the preceding figures, in combination with the possibility of measuring the wind intensity and direction variations by means of anemometer 601 and vane 602, respectively, it is possible to measure, at any instant, the effect that a wind variation causes on the horizontal position of the barycentre, and thus to determine the value of the overturning moment generated by the wind at any instant relative to each overturning line. Since it is known that such overturning moment is a function of wind speed $v_s$, and of the product of resisting surface A and ordinate $Y_W$ of the point of application of the force of the wind, and since machine 100 comprises means for measuring such wind speed $v_s$, machine 100 according to the embodiment of FIG. 6 permits an accurate computation of the product $A*Y_W$, i.e. the product of the resisting surface and the ordinate of the point of application of the force of the wind, without being bound, in the calculation of the residual stability angle, to assumptions and approximations as to the influence of the wind.

Using the same reference system X-Y-Z adopted previously, in fact, a barycentre position variation, caused by a variation of the force of the wind, having a value ΔX, which can still be precisely determined by means of load cells 208, corresponds to an equivalent moment Me=m*g*ΔX, where "m" is the mass of the machine and "g" is the gravitational acceleration. Such equivalent moment corresponds, therefore, to the moment generated by the force of the wind that would cause an equal displacement ΔX of the barycentre. For simplicity, reference will always be made hereafter to a displacement ΔX of the barycentre, but it is obvious that the concepts expressed herein will also apply to a displacement ΔZ in direction Z or to a displacement having two components, i.e. one along X and one along Y.

Being "p" the pressure of the wind, "A" the resisting surface of the machine, "$Y_W$" the ordinate of the point of application of the force of the wind, the following relationship will be obtained:

$$AY_w = \frac{M_e}{\Delta p}$$

According to the current reference standards, wind pressure "p" can be computed by using the formula $p=0.613*10^{-3}*v_s^2$, and hence pressure variation "Δp" can be computed knowing wind speed "$v_s$" both before and after the barycentre position variation (by means of installed anemometer 601). It is then possible to calculate with precision:

$\Delta p=0{,}613*10^{-3}*(v_{s2}^2-v_{s1}^2)$ and hence the product"$\Delta Y_W$".

According to the prior art, such product is generally obtained via approximations resulting from calculations and standards. As a matter of fact, calculating the wind resisting surface A for every possible direction is quite difficult. The resisting surface depends, in fact, on the projection of the machine surfaces on a plane perpendicular to the wind direction and, since the shape of the machine is asymmetric, such surface is different for each wind direction. It is also necessary to into take account the various configurations that the movable parts of the machine can take, in that for each configuration the areas of the surfaces exposed to the wind and the areas of the surfaces shielded by machine components will change. Moreover, the movable parts may also change the height, above ground or relative to a reference plane, of the surfaces being hit by the wind. Therefore, once resisting surface A is known, another difficult task is to compute ordinate $Y_W$ of the point of application of the force of the wind. The result of all this is that, in the prior art, in order to make the calculations simpler it was common to use the most penalizing value of the product thus $A*Y_W$, assuming the most unfavourable condition.

By means of the present invention, on the contrary, it is possible to accurately measure said product $A*Y_W$ in the field for every direction of the wind, based on the data received from vane 602, and for every configuration of machine 100.

By substituting, in the equations of the equivalent moment generated by the wind, the exact value of "$\Delta Y_W$" just computed, and by using, for example, only the limit values of "p" and "$v_s$", provided by the standards, or the measured values of "$v_s$", it is possible to compute with better precision the influence exerted by the actual forces of the wind upon the residual stability angle, for every wind direction and machine configuration, resulting in a big advantage for safety. The achievement of this result is due, in particular, to load cells 208 positioned on tracked undercarriage 101, jointly with anemometer 601 and vane 602.

In an exemplary application of the above, it would thus be possible to position the machine in a location where it is hit by the wind at a given speed and in a given direction with respect to the machine itself, in a specific operating configuration, and in the absence of any external forces and dynamic effects, and then measure the value of $A*Y_W$ for that condition and save it into a database included in the software of the machine. Then, by changing several times the orientation of the machine relative to the wind direction, it would be possible to obtain a value of $A*Y_W$ for each relative orientation between the machine and the wind. In this way it would be possible to store values of $A*Y_W$ for a given number of relative angles equidistant from one another within an interval of 360° (e.g. 8 measurements equally spaced apart by) 45°. Such data may subsequently be used by the software for computing and monitoring the stability.

The reference technical standards for excavation machines also require that the effects of the inertia forces acting upon the machine should be taken into consideration in the stability calculations.

Figure 4:
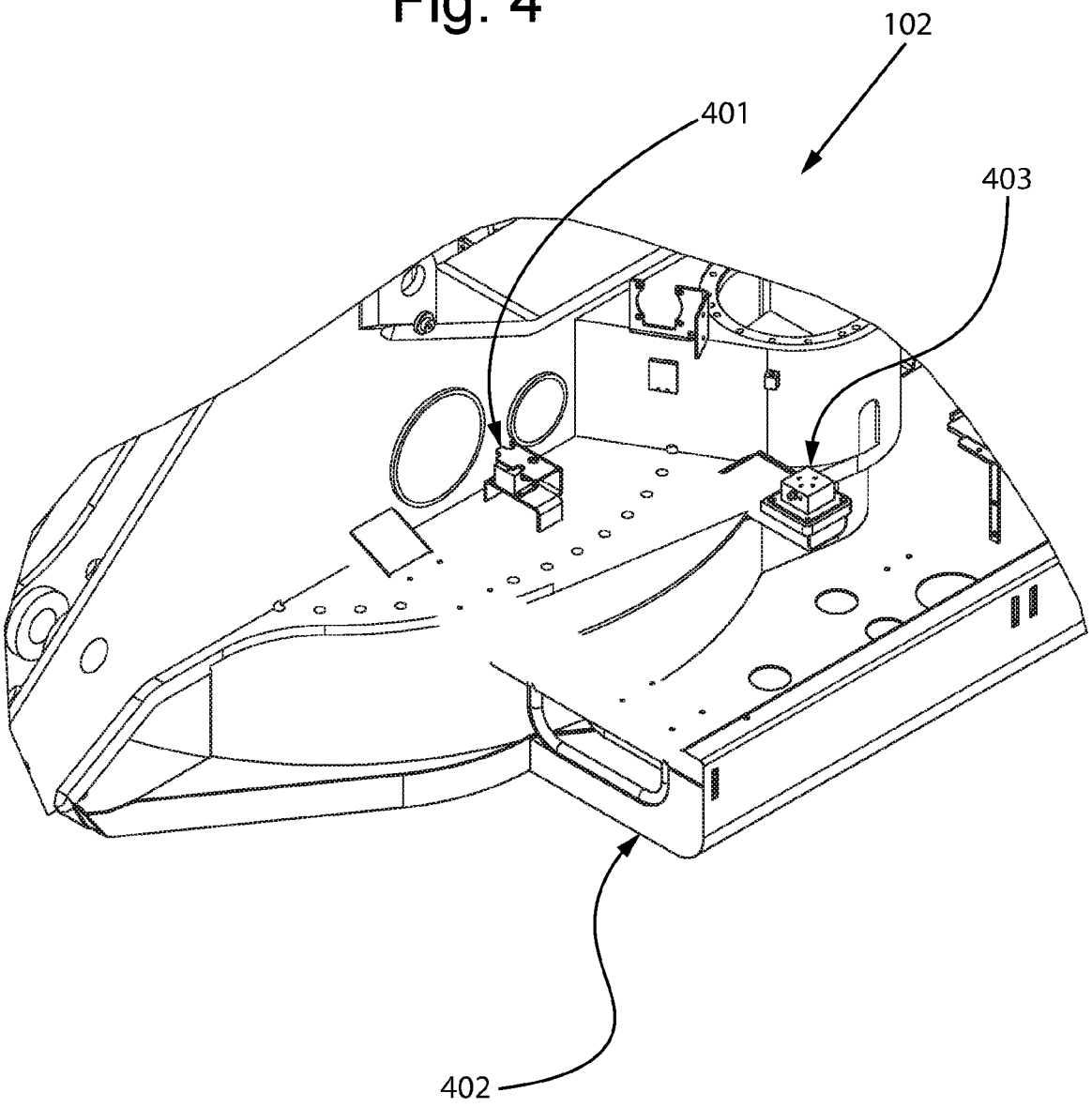
FIG. 4 is a magnified partial perspective view of a detail of the sensors applied to a frame of the excavation machine.
Figure 7:
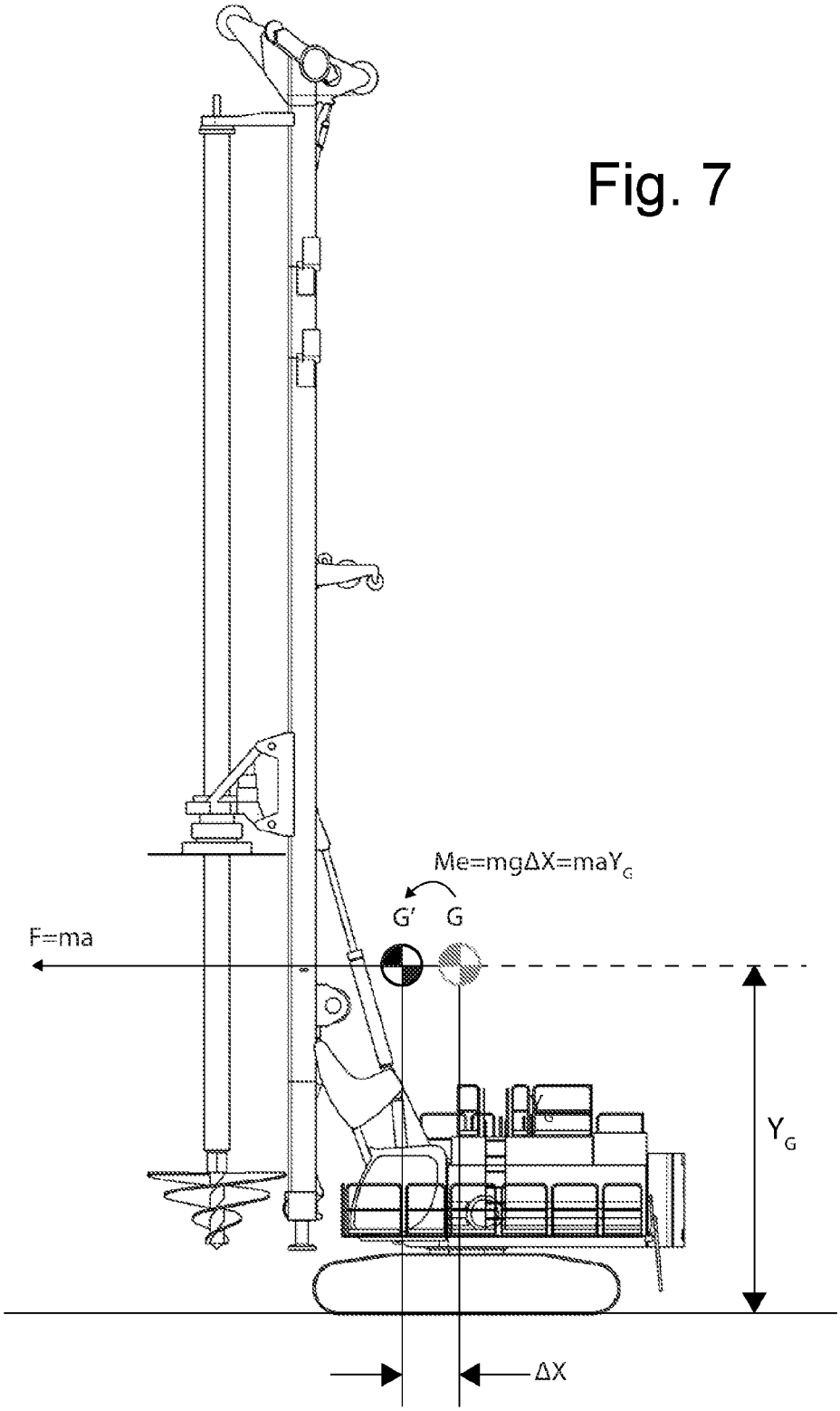
FIG. 7 is a side elevation view of the machine shown in FIGS. 3 to 6. This figure shows one possible example of the variables used for measuring some dynamic effects affecting stability, according to an advantageous embodiment of the present invention.

With reference to FIGS. 4 and 7, the use of accelerometer 403 mounted on machine 100 makes it possible, still on the basis of the indications provided by load cells 208, to exactly assess the inertia forces and obtain, in this case as well, according to a principle which is alternative to those previously described herein, the value of height coordinate $Y_G$ of the barycentre of machine 100. In particular, accelerometer 403 is configured for detecting acceleration data "a" indicative of the acceleration undergone by base machine 102. Control system CPU is configured for computing barycentre vertical position $Y_G$ as a function of the force data ($F_{antdx}$, $F_{antsx}$, $F_{postdx}$, $F_{postsx}$) and acceleration data a.

Figure 13:
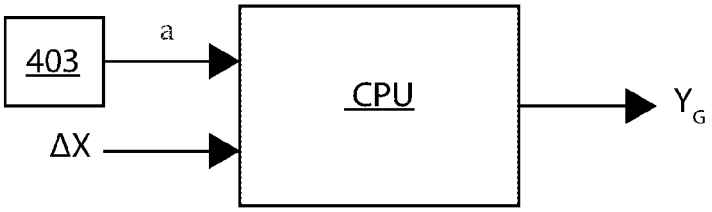

Advantageously, as shown in more detail in the block diagram of FIG. 13, for the computation of height coordinate $Y_G$ by control system CPU, acceleration data a detected by accelerometer 403 and indicative of the acceleration undergone by base machine 102 between two consecutive instants correspond, in this case as well, to a position variation $\Delta X$ of barycentre planar position $X_G$, $Z_G$ (in particular, between positions G and G') in such consecutive instants. Such condition corresponds to an equivalent moment $M_e=m*g*\Delta X$. Furthermore, the above-indicated equivalent moment is equal to $M=m*a*Y_G$.

Therefore, the value of the height coordinate $Y_G$ is computed by the control system according to the following formula:

$$Y_g = \frac{g\Delta X}{a}$$

It is thus also possible, by associating the information from load cells 208, which permit calculating parameter $\Delta X$, with the information from accelerometer 403, to obtain a value of $Y_G$ which is calculated in real time, instead of being determined a priori with some approximation.

In addition, accelerometer 403 may also be used for effecting a feedback limitation of excessively harsh manoeuvres that might endanger the stability of machine 100 or, more in general, for knowing the accelerations involved in any operating condition.

All these results, when compared and processed by control system CPU aboard machine 100, permit obtaining an instantaneous three-dimensional measurement of position $X_G$, $Y_G$, $Z_G$ of the barycentre of the machine and of the residual stability angle, resulting in improved safety.

This information may then be used for warning the operator by means of well-known audiovisual systems, such as indicator lights, displays, buzzers or the like, and may also start a feedback control procedure to put the machine in a safe condition or prevent the operator from making dangerous manoeuvres.

In light of the above description, in the machines made in accordance with the prior art the sensors of motion actuators 301, 302, 303, 304 alone, without load cells and inclinometer, would only allow for a less precise approximation of the residual stability angle also because such installed sensors 301, 302, 303, 304 would be insufficient to take into account many factors that affect such calculation. For example, it would not be possible to consider the dynamic effect of the motion of fluids like diesel fuel and hydraulic oil, contained in respective tanks installed on base machine 102, which is generated during the manoeuvres for stopping or starting the machine or when stopping or starting the rotation of base machine 102 relative to the undercarriage. These movements of the fluidic masses are not taken into account in the traditional calculation methods, which consider them to be fixed, thus making an approximation.

Another factor that sensors 301, 302, 303, 304 cannot effectively detect is the movement of the mass of hydraulic hoses, e.g. those that supply the rotary, which change their position depending on the position taken by the rotary along the mast.

In the embodiment of the present invention illustrated herein, on the contrary, such inaccuracies are overcome by relying on instantaneous measurements of forces and angles.

In a variant further implementation (not shown), machine 100 resembles the one previously described, but has six, as opposed to four, load cells 208.

For example, the six load cells may include:

- a pair of front load cells mounted at the point of connection between a lateral track 204 and front transverse assembly 203*a*,
- a pair of other front load cells mounted at the point of connection between the other lateral track 205 and front transverse assembly 203*a*,
- a rear load cell mounted at the point of connection between a lateral track 204 and rear transverse assembly 203*b*,
- a rear load cell mounted at the point of connection between lateral track 204 and rear transverse assembly 203*b*.

As an alternative to such example, the six load cells may include:

- a front load cell mounted at the point of connection between a lateral track 204 and front transverse assembly 203*a*,
- a front load cell mounted at the point of connection between the other lateral track 205 and front transverse assembly 203*a*,
- a pair of rear load cells mounted at the point of connection between a lateral track 204 and rear transverse assembly 203*b*, a pair of other rear load cells mounted at the point of connection between lateral track 204 and rear transverse assembly 203*b*.

Figure 8A:
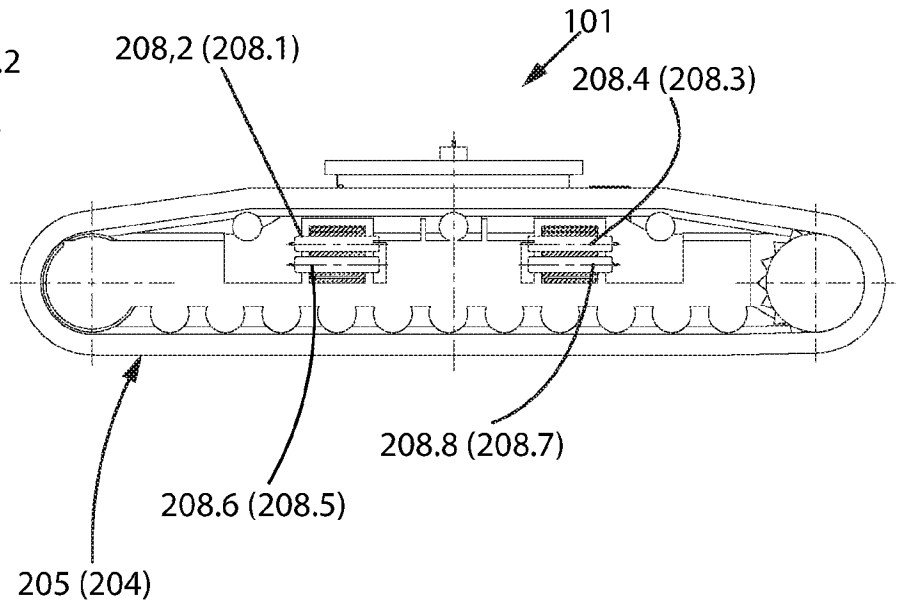
FIG. 8A is a partially sectional side elevation view that shows one possible variant implementation of an undercarriage applicable to one of the machines illustrated in the preceding figures.
Figure 8B:
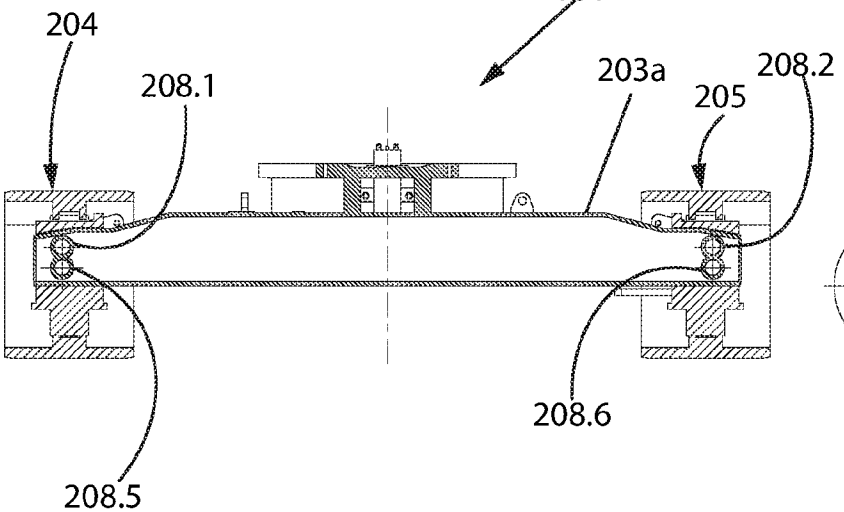
FIG. 8B is a sectional view of the undercarriage 8A in the plane Y-Z and passing through one of the transverse assemblies of said undercarriage.

In yet another variant t implementation, as shown in FIGS. 8A and 8B, the machine resembles the one previously described, but has eight, as opposed to four, load cells, which include:

a pair of front load cells 208.1, 208.5 mounted at the point of connection between a lateral track 204 and front transverse assembly 203*a*, a pair of other front load cells 208.2, 208.6 mounted at the point of connection between the other lateral track 205 and front transverse assembly 203*a*, a pair of rear load cells 208.3, 208.7 mounted at the point of connection between a lateral track 204 and rear transverse assembly 203*b*, a pair of other rear load cells 208.4, 208.8 mounted at the point of connection between a lateral track 204 and the rear transverse assembly 203*b*.

Therefore, according to such further variant, instead of each one of the four load cells 208 illustrated herein, one pair of load cells 208 is housed at each point of connection between transverse assemblies 203*a* and 203*b* and tracks 204, 205. In particular, the two load cells 208 of each pair housed at each connection point are mounted parallel to and offset from each other, thus being non-coaxial to each other (or axially spaced apart).

As visible in the sectional view of FIG. 8B, each end of a transverse assembly 203*a*, 203*b* is connected to respective track 204, 206 by means of two respective pin-shaped load cells 208, which form a double-hinge connection, with mutually offset centres of rotation. As a result, such connection provides a rigid constraint between each transverse assembly 203*a*, 203*b* and respective track 204, 206, thus permitting no oscillation or rotation of tracks 204 and 205.

Advantageously, in the control system of machine 100 a feedback/correction software program is implemented, assisted by suitable (visual or not) means, which can interact with the operator to avoid any dangerous situations due to an insufficient residual stability angle.

Advantageously, in the construction variant of the machine wherein the undercarriage has four load cells 208, the coupling between the end of each transverse assembly 203*a*, 203*b* and the point of connection of respective track 204, 205 may be effected in such a way as to allow a small angle of oscillation of the track, as already explained with reference to FIG. 2B. Such small oscillation gives a first advantage of permitting tracks 204, 205 to adapt themselves to small lateral inclinations of the ground, i.e. moderate slopes in a direction transversal to the direction of travel. A second advantage is attained in the presence of overturning moments with respect to one of the two lateral overturning lines LRLS, LRLD. In such conditions, when a condition that might lead to overturning is about to occur, a small inclination of central body 202 of the undercarriage and of all the overlying machine will take place, which will make a small rotation relative to track 204, 205 located on the lateral overturning line. The amplitude of such small rotation will be limited by the play existing between the end of each transverse assembly 203*a*, 203*b* and the point of connection of respective track 204, 205. After this small rotation, the oscillation movement will stop, and track 204 or 205 located on the side opposite to the overturning line, which can also oscillate by a small angle, before rising from the ground will counter the overturning with a significant fraction of its mass.

The operator, being warned by a clear signal that a dangerous situation is about to occur, consisting of the machine tilting relative to track 204 or 205, will still benefit from sufficient stability to be able to return into safe conditions. This will give the operator or the machine itself more time to take action in order to restore safe conditions. This is only possible for the lateral overturning lines, which are the most critical ones due to construction reasons.

Advantageously, by directly measuring the reaction forces between each lateral track 204, 205 and the respective transverse assembly 203*a*, 203*b*, machine 100 can automatically detect the effects of any variations that may have occurred in the equipment of the machine, thus avoiding to leave up to the operator the task of entering updated data into the software when such a change of equipment is made. Merely by way of example, if excavation tool 106 of the machine is replaced with a heavier tool, the weight of that part of the machine which is suspended from undercarriage 101 will increase and a corresponding increase in the reaction forces measured by cells 208 will occur. From that very instant, the control system of the machine will compute a new position of the barycentre of the machine, which will take into account both the weight of the new tool and the spatial position of such tool.

Of course, without prejudice to the principle of the invention, the forms of embodiment and the implementation details may be extensively varied from those described and illustrated herein by way of non-limiting example, without however departing from the scope of the invention as set out in the appended claims.

The invention claimed is:

1. A machine for making excavations for drilling, comprising a tracked undercarriage and a base machine supported by the tracked undercarriage; the tracked undercarriage comprising:

a frame comprising a central body, a front transverse assembly and a rear transverse assembly connected to the central body and protruding from opposite sides of the central body, a pair of lateral tracks, each one of the tracks being connected to an end of the front transverse assembly on one side and to an end of the rear transverse assembly on the other side;

the base machine comprising excavation equipment adapted to take different working positions or configurations;

at least four load cells including:

a front load cell mounted at a point of connection between a lateral track and the front transverse assembly, another front load cell mounted at a point of connection between the other lateral track and the front transverse assembly, a rear load cell mounted at a point of connection between a lateral track and the rear transverse assembly, another rear load cell mounted at a point of connection between the other lateral track and the rear transverse assembly;

wherein each one of the load cells is configured for detecting force data indicative of a reaction force exerted between the associated lateral track and the respective transverse assembly; and wherein the machine further comprises a control system configured for computing at least a barycentre planar position of the machine situated substantially at a level of a reference plane, the barycentre planar position being computed as a function of the force data.

2. The machine according to claim 1, wherein the control system is configured for computing the barycentre planar position without considering any detections referred to the working positions or configurations taken by the excavation equipment of the base machine.

3. The machine according to claim 1, wherein the control system is configured for computing a barycentre vertical position of the machine, which is indicative of a height relative to the reference plane.

4. The machine according to claim 3, further comprising an inclinometer configured for detecting angle data indicative of at least one angle of inclination between a reference axis of the base machine and the direction of the force of gravity; the barycentre vertical position being computed by the control system as a function of the force data and the angle data.

5. The machine according to claim 4, wherein the barycentre vertical position is computed by the control system as a function of:

a position variation of the barycentre planar position in the reference plane, computed between two consecutive instants, and an angle variation of the angle data detected by the inclinometer between the two consecutive instants.

6. The machine according to claim 4, wherein the inclinometer includes a single-axis and the angle data include only one angle of inclination.

7. The machine according to claim 4, wherein the inclinometer includes two axes and the angle data include a pair of angles of inclination.

8. The machine according to claim 3, further comprising an accelerometer configured for detecting acceleration data indicative of acceleration undergone by the base machine; the control system being configured for computing the barycentre vertical position as a function of the force data and the acceleration data.

9. The machine according to claim 8, wherein the barycentre vertical position is computed by the control system as a function of:

a position variation of the barycentre planar position, computed between two consecutive instants, and the acceleration data detected by the accelerometer between the two consecutive instants.

10. The machine according to claim 1, further comprising an anemometer configured for detecting speed data indicative of the speed of the wind, and a vane configured for detecting direction data indicative of the direction of the wind; the control system being configured for computing the product of the resisting surface of the machine and the height of the centre of application of the force of the wind as a function of the force data, the speed data and the direction data.

11. The machine according to claim 10, wherein the product is computed by the control system as a function of:

a position variation of the barycentre planar position, computed between two consecutive instants, and a wind pressure variation computed on the basis of the speed data and the direction data detected between the two consecutive instants.

12. The machine according to claim 1, wherein the control system is configured for providing feedback control of the excavation equipment of the base machine as a function of at least the barycentre planar position.

13. The machine according to claim 1, further comprising an audible and/or visual signaling device co-operating with the control system and configured for outputting a perceivable danger signal as a function of at least the barycentre planar position.

14. The machine according to claim 1, wherein each load cell connects the associated lateral track and the respective transverse assembly through a seat formed at an end of the respective transverse assembly and at least one corresponding seat formed in a portion of the associated track.

15. The machine according to claim 14, wherein each one of the load cells is shaped as a substantially cylindrical pin.

16. The machine according to claim 1, comprising at least six of the load cells distributed among the points of connection between the lateral tracks and the transverse assemblies.

17. The machine according to claim 16, comprising at least eight of the load cells, including:

a pair of front load cells mounted at the point of connection between a lateral track and the front transverse assembly, a pair of other front load cells mounted at the point of connection between the other lateral track and the front transverse assembly, a pair of rear load cells mounted at the point of connection between a lateral track and the rear transverse assembly, a pair of other rear load cells mounted at the point of connection between a lateral track and the rear transverse assembly.

18. The machine according to claim 17, wherein:

the front load cells extend along two respective non-coaxial longitudinal axes;

the other front load cells extend along two respective non-coaxial longitudinal axes;

the rear load cells extend along two respective non-coaxial longitudinal axes; and the other rear load cells along two respective non-coaxial longitudinal axes.

19. The machine according to claim 1, wherein the transverse assemblies are rotatably integral with the central body.

20. A method for controlling a machine for making excavations, the method comprising the operative steps of:

providing a drilling machine comprising a tracked undercarriage and a base machine supported by the tracked undercarriage; the tracked undercarriage comprising:

a frame comprising a central body, a front transverse assembly and a rear transverse assembly connected to the central body and protruding from opposite sides of the central body;

a pair of lateral tracks, each one of the tracks being connected to an end of the front transverse assembly on one side and to an end of the rear transverse assembly on the other side;

the base machine comprising excavation equipment adapted to take different working positions or configurations;

detecting force data indicative of a reaction force exerted between each lateral track and each transverse assembly by four load cells including:

a front load cell mounted at a point of connection between a lateral track and the front transverse assembly, another front load cell mounted at a point of connection between the other lateral track and the front transverse assembly, a rear load cell mounted at a point of connection between a lateral track and the rear transverse assembly;

another rear load cell mounted at a point of connection between the other lateral track and the rear transverse assembly;

computing a barycentre planar position referred to the centre of gravity of the machine and situated substantially at a level of a reference plane as a function of the force data.

21. The method according to claim 20, wherein the barycentre planar position is computed without considering any detections referred to positions and configurations taken by the excavation equipment of the base machine.

22. The method according to claim 20, further comprising the operative step of computing a barycentre vertical position referred to the centre of gravity of the machine and indicative of the height relative to the reference plane.

23. The method according to claim 22, further comprising the operative step of detecting, by an inclinometer, angle data indicative of at least one angle of inclination between a reference axis of the base machine substantially perpendicular to the reference plane and the direction of the force of gravity; the barycentre vertical position being computed as a function of the force data and the angle data.

24. The method according to claim 23, wherein the barycentre vertical position is computed as a function of:

a position variation of the barycentre planar position, computed between two consecutive instants, and an angle variation of the angle data detected between the two consecutive instants.

25. The method according to claim 24, further comprising the operative step of detecting, by an accelerometer, acceleration data indicative of acceleration undergone by the base machine;

the barycentre vertical position being further computed as a function of the force data and the acceleration data.

26. The method according to claim 25, wherein the barycentre vertical position is further computed as a function of:

the position variation of the barycentre planar position, computed between two consecutive instants, and the acceleration data detected between the two consecutive instants.

27. The method according to claim 20, further comprising the operative steps of:

detecting, by an anemometer, speed data indicative of the speed of the wind and, by a vane, direction data indicative of the direction of the wind;

computing the product of the resisting surface of the machine and a height of a centre of application of the force of the wind as a function of the force data, the speed data and the direction data.

28. The method according to claim 27, wherein the product is computed as a function of:

a position variation of the barycentre planar position, computed between two consecutive instants, and a wind pressure variation computed based on the speed data and the direction data detected between the two consecutive instants.

29. The method according to claim 20, further comprising the operative step of providing feedback control of the base machine as a function of at least one parameter selected from the group including: the barycentre planar position, the barycentre vertical position and the product.

30. The method according to claim 20, further comprising the operative step of outputting a perceivable danger signal as a function of at least one parameter selected from the group including the barycentre planar position, the barycentre vertical position and the product.

* * * * *